US010730669B2

(12) United States Patent
Cesare et al.

(10) Patent No.: US 10,730,669 B2
(45) Date of Patent: Aug. 4, 2020

(54) CLOSURE

(71) Applicant: Conopco, Inc., Englewood Cliffs, NJ (US)

(72) Inventors: Slavica Cesare, Trumbull, CT (US); Gregory Lalier, Brookfield, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/611,781

(22) Filed: Jun. 1, 2017

(65) Prior Publication Data

US 2017/0297780 A1 Oct. 19, 2017

Related U.S. Application Data

(63) Continuation-in-part of application No. PCT/EP2016/081755, filed on Dec. 19, 2016.

(30) Foreign Application Priority Data

Dec. 23, 2015 (EP) ..... 15202602

(51) Int. Cl.
*B65D 41/17* (2006.01)
*B65D 41/04* (2006.01)
(Continued)

(52) U.S. Cl.
CPC ..... *B65D 41/17* (2013.01); *B65D 41/0471* (2013.01); *B65D 41/34* (2013.01);
(Continued)

(58) Field of Classification Search
CPC ..... B65D 41/34; B65D 47/08; B65D 41/17; B65D 41/0471; B65D 41/16
(Continued)

(56) References Cited

U.S. PATENT DOCUMENTS 4,991,733 A * 2/1991 Marino ..... B65D 41/0471 215/216
5,145,080 A 9/1992 Imbery, Jr.
(Continued)

FOREIGN PATENT DOCUMENTS

CN 2734649 10/2005
CN 2734649 Y * 10/2005
(Continued)

OTHER PUBLICATIONS

Search Report and Written Opinion in EP15202602, dated Jun. 2, 2016.

(Continued)

*Primary Examiner* — James N Smalley
(74) *Attorney, Agent, or Firm* — Gerard J. McGowan, Jr.

(57) ABSTRACT

An improved snap-on/twist off closure which is very durable. The invention is also directed to a package comprising the closure, e.g., a bottle in combination with the closure. The closure includes an upper wall defining an opening and a cylindrical snap on pipe depending from the upper wall. The pipe includes threads designed to mate with external threads on a neck of the bottle. The threads on the pipe and threads on the neck of the bottle pass over each other when the closure is snapped onto the bottle during manufacture. The pipe includes a resistance recess and a guidance recess. The resistance recess and the guidance recess accommodate a forcing element on a shoulder of the bottle and permit unscrewing of the closure

19 Claims, 4 Drawing Sheets

(51) Int. Cl.
*B65D 47/08* (2006.01)
*B65D 41/34* (2006.01)
*B65D 41/16* (2006.01)

(52) U.S. Cl.
CPC ..... *B65D 47/08* (2013.01); *B65D 47/0838* (2013.01); *B65D 41/16* (2013.01)

(58) Field of Classification Search
USPC ..... 215/216, 330, 331, 318
See application file for complete search history.

(56) References Cited

U.S. PATENT DOCUMENTS

| | | | | |
|---|---|---|---|---|
| 5,690,242 | A * | 11/1997 | Campbell, Jr. | B65D 55/022 206/365 |
| 5,992,656 | A * | 11/1999 | Dujardin | B29C 45/14598 215/330 |
| D542,141 | S | 5/2007 | Okin et al. | |
| D546,693 | S | 7/2007 | Okin et al. | |
| 8,365,933 | B2 | 2/2013 | Jackel | |
| 2004/0245204 | A1 | 12/2004 | Suffa | |
| 2010/0288787 | A1* | 11/2010 | Jackel | B65D 41/17 220/834 |

FOREIGN PATENT DOCUMENTS

| | | | | |
|---|---|---|---|---|
| CN | 1697757 | | 11/2005 | |
| CN | 1697757 | A * | 11/2005 | B65D 41/06 |
| CN | 201400373 | | 2/2010 | |
| CN | 201400373 | Y * | 2/2010 | |
| EP | 0104501 | | 4/1984 | |
| EP | 0179706 | A1 * | 4/1986 | B65D 41/0471 |
| EP | 0179706 | | 2/1988 | |
| EP | 2921232 | | 9/2015 | |
| JP | 5681049 | | 7/1981 | |
| JP | S5943348 | | 3/1984 | |
| WO | WO02081316 | | 10/2002 | |
| WO | WO2017108697 | | 6/2017 | |

OTHER PUBLICATIONS

Search Report and Written Opinion in PCTEP2016081755, dated Feb. 2, 2017.
IPRP2 in PCTEP2016081755 dated Nov. 9, 2017.
Search Report and Written Opinion in PCTEP2018064188.
Co-pending U.S. Appl. No. 16/065,173, entitled "Closure", filed Jun. 22, 2018, based on PCT filed Dec. 19, 2016 and EP filed Dec. 23, 2015.

* cited by examiner

CLOSURE

BACKGROUND OF THE INVENTION

Numerous personal care products are sold in plastic bottles. Examples of such products are body washes and shampoos. While dispensing of a body wash or hair care product from a bottle is convenient for the consumer, plastic bottles generally are disposed of after one use and sometimes undesirably find their way into landfills. Although plastic bottles are sometimes recycled, both transportation to the recycling facility and recycling itself utilize energy. Accordingly, it would be preferable if the packaging were re-used instead of discarded after a single use.

While some present commercial bottles could theoretically be re-used by consumers, the ease of doing so generally leaves something to be desired. For instance, it may be difficult for a consumer to remove the closure sufficiently to facilitate access to the body of the bottle. This creates a considerable impediment to the goal of minimization of plastic usage and disposal. Therefore, there has been a need for a bottle having a closure which can readily be removed by the consumer. Moreover, it is important that the consumer be able easily to again secure the closure to the bottle once she has refilled the container.

Easy consumer access to the interior of the bottle is certainly desirable, but the bottle cannot be designed such that the closure will separate from the bottle too readily. Otherwise, product will be released from the container at inopportune times, such as during transportation. Also, the goal of a readily separable closure must be balanced with a competing goal, namely ease of placing the closure on the bottle during manufacture and attendant minimization of production costs.

Jackel U.S. Pat. No. 8,365,933 discloses a closure system including a snap-on closure which can be pressed upon a spout wherein two interacting dements are shifted by or over one another due to their flexibility. The closure can only be removed with difficulty in the strictly axial/vertical direction by exerting a certain force, but can be removed by a rotational motion which is significantly easier to perform than the axial removal motion. The closure includes a recess in a cylindrical snap-on pipe which engages with a forcing element on the container shoulder. The sides of the recess are designed so that the gradient at one point on one side is smaller than the gradient at the same point on the other side.

SUMMARY OF THE INVENTION

The present invention is directed to an improved snap-on/twist off closure which does not suffer from some disadvantages of prior closures. In particular, it is very durable, as can be seen in the standard industry drop test. The invention is also directed to a package comprising the closure, e.g., a bottle in combination with the closure.

The base of the closure of the invention includes an upper wall defining an opening and a cylindrical snap-on pipe depending from the upper wall and extending vertically/axially to a bottom pipe end. The cylindrical snap-on pipe includes threads on inner wall designed to mate with external threads on a neck of the bottle. The closure base is snap fit onto the bottle neck whereby the thread of the cylindrical snap-on pipe passes over and temporarily locks beneath the thread of the container neck.

The closure cylindrical snap-on pipe includes at its bottom end at least one resistance recess and at least one guidance recess. The resistance and guidance recesses play roles in the unscrewing of the closure whereby it can be easily removed for refilling. The resistance recess includes opposing first and second walls defined by the cylindrical snap-on pipe and which have gradients wherein the gradient of one of the walls is smaller at east at one point than the gradient on the other wall at a point lying at the same axial/vertical height.

When the closure is dosed, a forcing element from the container is at east partially accommodated within the resistance recess. The resistance recess wall with the higher gradient contacts the forcing element, which resists turning of the closure in one (non-opening/screwing closed/closure securing) direction, usually the clockwise direction. When the closure is turned in the opposite, or opening/unscrewing/closure removal direction, contact between the gentler gradient of the opposite wall of the resistance recess and the forcing element forces the closure slightly upwardly. During this initial rotation the internal thread on the cylindrical snap-on pipe maintain its/their position below the external thread of the container neck as the closure travels axially upwardly relative to the container neck. The axial motion results from the fact that the threads are angled; the net result of the angled rotational movement is axial movement. Alternatively, the closure may be structured so that with sufficient axial force, e.g., exerted by the consumer, even during the initial rotation once the forcing element is disengaged from the resistance recess, the internal thread on the snap on pipe may pass over the external thread of the container neck to facilitate removal of the closure.

Upon further turning of the closure in the counterclockwise or unscrewing/opening direction, the forcing element encounters the trailing end of the resistance recess followed by the bottom rim of the snap-on pipe and then by a guidance recess. During rotation of the closure in the unscrewing/opening direction, the guidance recess first extends upwardly from the bottom end to permit lowering of the cylindrical snap-on pipe relative to the container neck while the mating threads on the closure cylindrical snap-on pipe and container neck contact each other. Thereafter, with the cylindrical snap-on pipe and neck threads still in engagement, as the closure is rotated further in the unscrewing/opening/closure removal direction, the guidance recess includes a gradual downward gradient toward the bottom end of the cylindrical snap-on pipe.

The downward gradient of the guidance recess, and resultant relative upward motion of the closure consistent with the gradients of the matching threads on the container neck and skirt, provides guidance and offers minimal resistance to turning of the closure in the unscrewing/opening direction. The consumer can continue turning the closure with minimal resistance whereby to eventually remove the closure. The presence of the guidance recess also facilitates the reverse process wherein the consumer rotates the closure in the closing, usually clockwise, direction after having refilled the bottle. It is believed that without the guidance recess the bottom of the snap-on pipe would inhibit engagement of the threads upon screwing-on of the closure.

The closure may include a closing element which contacts and/or covers the top wall of the closure base to seal the closure opening, but which can be removed from the opening to dispense the product. Preferably the closing element remains associated with the closure base when removed to dispense the product, e.g., as the result of a hinge or other attachment.

The bottom rim of the snap-on pipe extending between the resistance recess and the guidance recess is preferably at least 2 mm and is up to 5 mm, especially from 2 to 4 mm, in length whereby to maximize durability of the closure, including promoting a good, comfortably tight, fit of the closure on the bottle over a prolonged period of use.

The closure of the invention permits secure placement of a closure on the bottle neck during manufacture yet easy removal of the closure from, and re-application of the closure to, the bottle by the consumer, thereby encouraging removal of the closure to refill the container. The closure is durable, e.g., is resistant to wear and tear.

It will be apparent that changes such as the directions of screwing/unscrewing and the locations of the threads may require adjustments in the locations and shape of the resistance and guidance recesses.

For a more complete understanding of the above and other features and advantages of the invention, reference should be made to the following detailed description of preferred embodiments and to the accompanying drawings.

BRIEF DESCRIPTIONS OF THE DRAWINGS

DETAILED DESCRIPTION OF THE INVENTION

Figure 2:
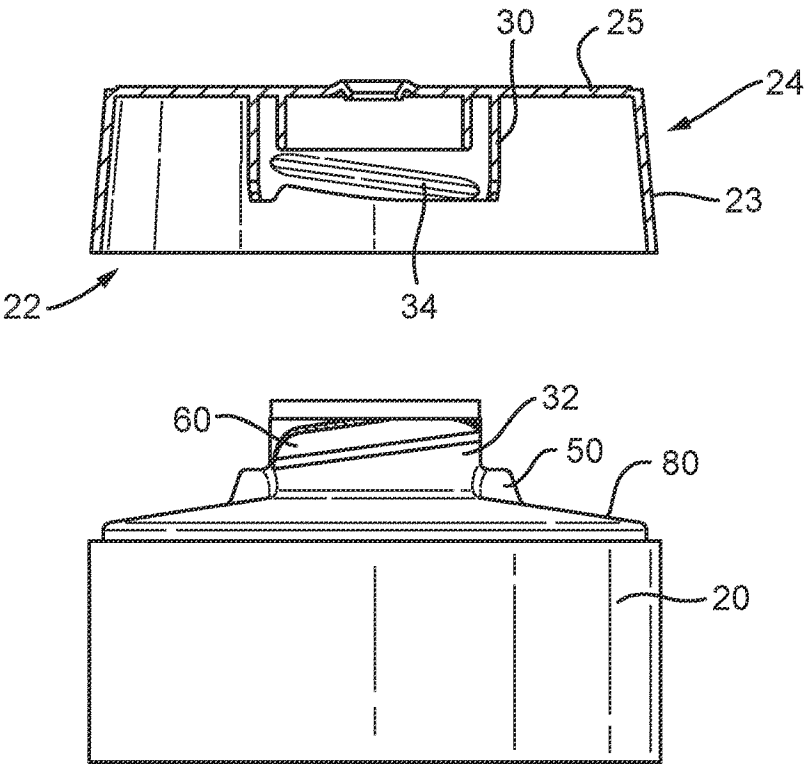
FIG. 2 is a front elevational view of a bottle of the invention with a portion of the is neck cut away and showing the closure base above it in cross section with the closing cover removed.
Figure 5:
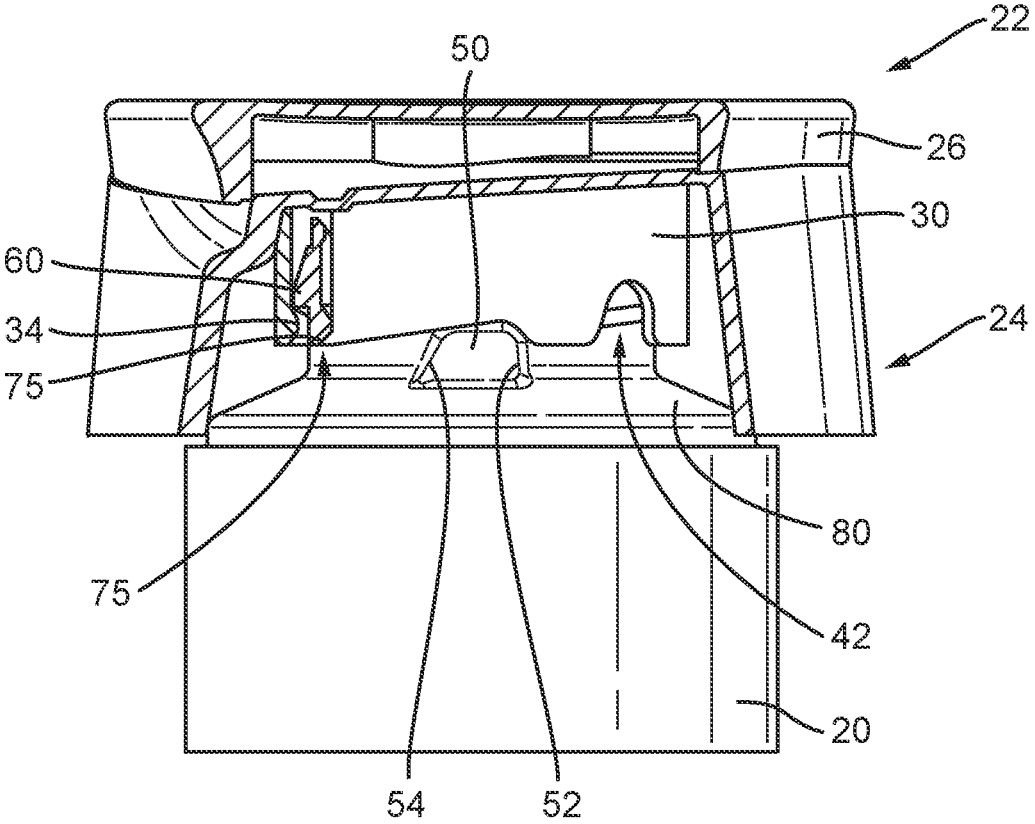
FIG. 5 is a side elevation of the package of the invention with the closure partly rotated in the unscrewing/opening/closure removal direction and with portions of the closure broken away to reveal the cylindrical snap-on pipe.
Figure 6:
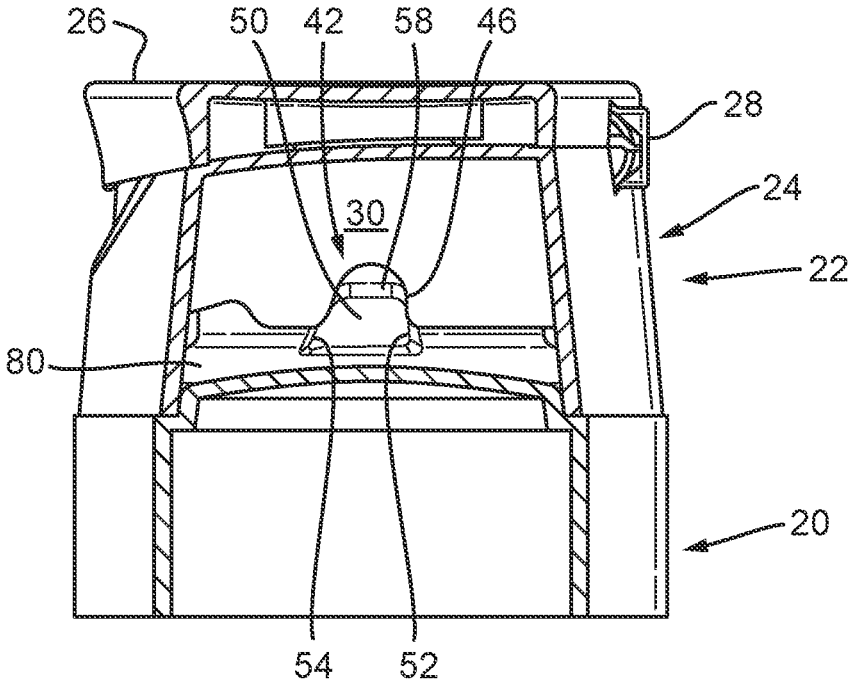
FIG. 6 is a side elevational view of an upper portion of the container with portions of the closure broken away and with the closure in the fully closed position.

Closure 22 sits on bottle 20 (FIGS. 5 and 6). Closure 22 includes closure base 24 connected to closing cover 26 by hinge 28, although other possible arrangements will be apparent to one of ordinary skill in the art. Closure base 24 includes generally cylindrical snap-on pipe 30, best seen in FIGS. 1 and 2, depending downwardly from upper wall 25. Cylindrical snap-on pipe 30 is positioned to engage neck 32 of bottle 20. The inner wall of cylindrical snap-on pipe 30 includes one or more internal threads 34, which protrude inwardly.

Closure base 24 includes a dispensing opening 36 centrally disposed within upper wall 25. Although opening 36 is illustrated and described as being centrally disposed, it may be off-center if desired. Structure may be provided above and/or below opening 36 to assist with pouring or sealing, such as ring 38. When closure base 24 is positioned on bottle 20, opening 36 is in communication with the interior of bottle 20 through the interior of snap-on pipe 30 and exterior closure base wall 23. Closing cover 26 includes plug 40 to assist in sealing the closure and ultimately the bottle.

Neck 32 of bottle 20 includes external threaded protrusion 60.

Figure 1:
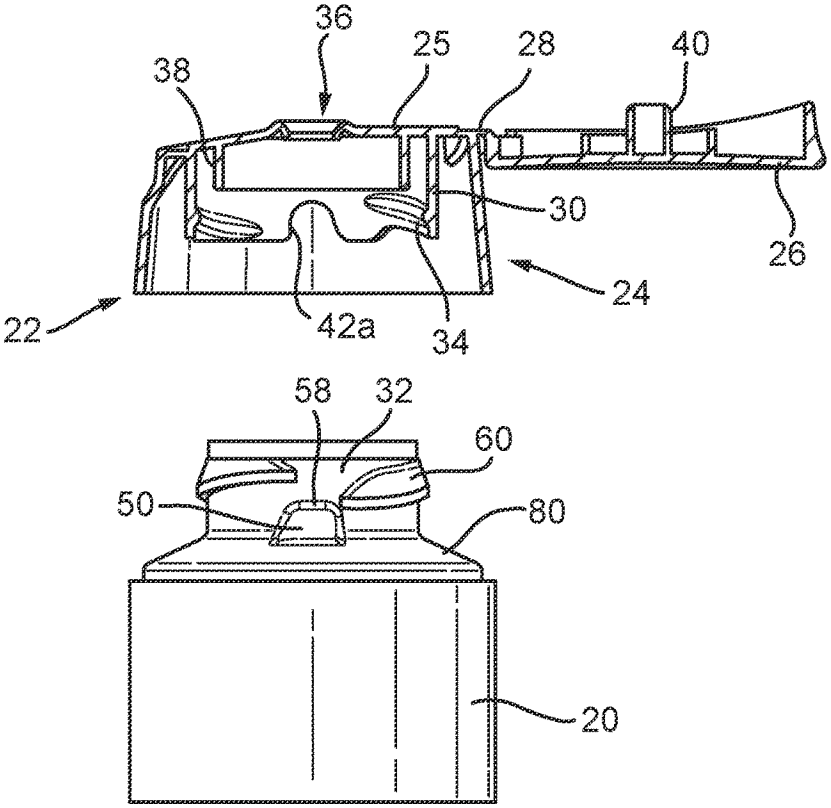
FIG. 1 is a side elevational view of the bottle and closure of the invention with the closure in cross section
Figure 3:
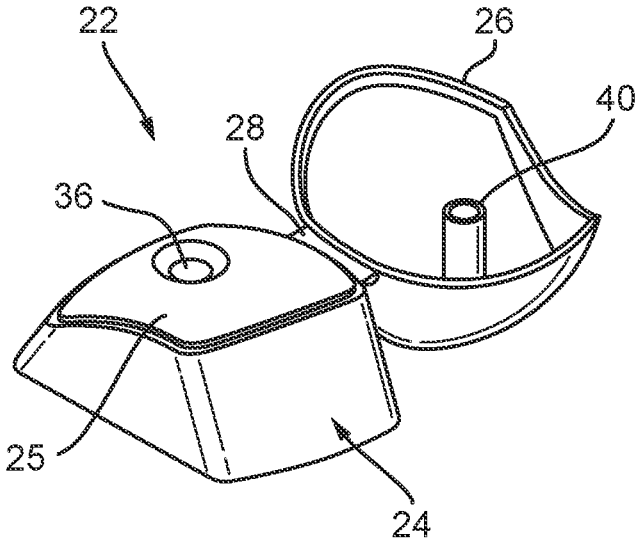
FIG. 3 is a perspective view from above of a closure according to the invention in the open position.
Figure 4:
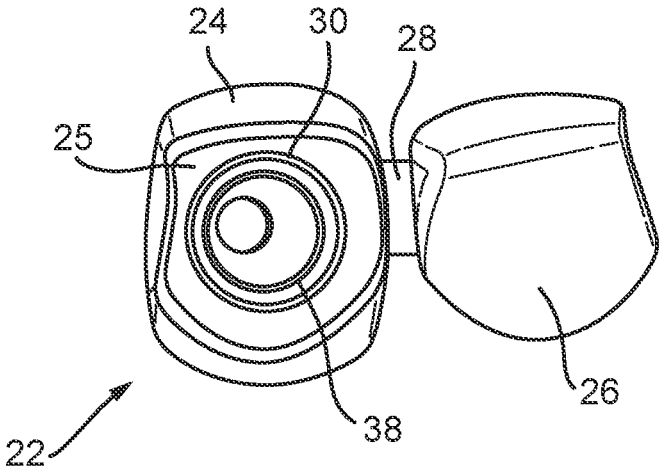
FIG. 4 is a bottom plan view of the closure of FIG. 3.
Figure 7:
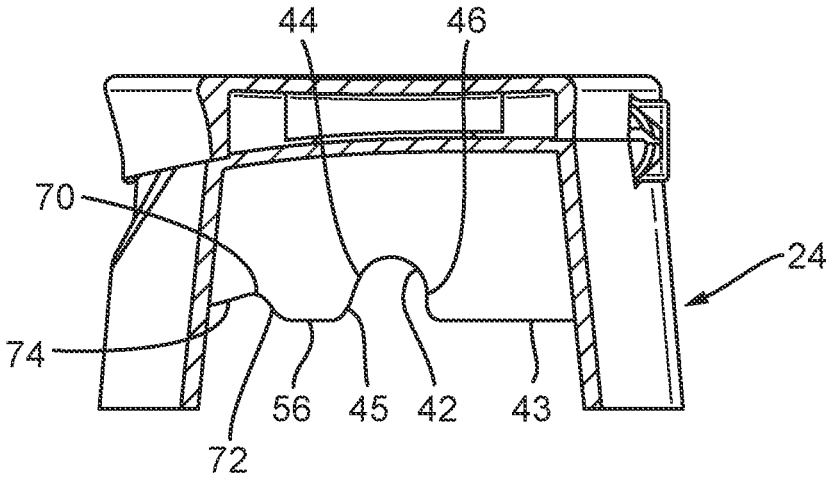
FIG. 7 is a side elevational view of the closure with portions broken away.

As best seen in FIGS. 5-7, cylindrical snap-on pipe 30 includes resistance recess 42 extending upwardly from bottom end or rim 43. Rim 43 typically extends perpendicularly to the downwardly extending axis of the pipe. A second resistance recess 42*a* may be present 180° removed from resistance recess 42, as seen in FIG. 1. Resistance recess 42 includes two walls 44, 46 formed in cylindrical snap-on pip, 30. The shape of walls 44, 46 will depend upon the direction which it is desired to have the closure rotate in order to release it from the bottle so that it can be removed.

Typically, closures are unscrewed/opened/removed by turning counterclockwise, so for the purpose of the present description counterclockwise unscrewing/opening will be assumed. However, it will be apparent that a different direction could be used if desired and the shapes of walls 44, 46 and the location of guidance recess 70 will be adjusted accordingly.

As best seen in FIG. 6, when the closure is in the closed position, resistance recess 42 receives at least part of forcing element 50, which is a protrusion permanently associated with bottle shoulder 80.

The trailing resistance recess wall during unscrewing/opening rotation, illustrated as 44 in FIG. 7, includes at its lower end 45 a gradient which is more gradual than that of the opposite (leading) recess wall 46; the gradient at the lower end of resistance recess wall 46 is more severe or steep. The forcing element 50 also includes two side walls 54, 52 of different gradients.

Starting from the initially closed position shown in FIG. 6, if the closure is rotated in the clockwise direction as the consumer turns it, a steep gradient of forcing element side wall 52 faces a steep gradient on resistance recess wall 46 and prevents rotation. On the other hand, upon rotation of the closure in the counterclockwise direction from the initially closed position, side wall 54 of the forcing element having a gentler gradient faces resistance recess wall 44 which has a gentler gradient in its lower half, e.g., at 45, proximate its base. The effect of this contact between walls of gentler gradients is that, instead of prevention of rotation, which occurs with the steeper gradients, the forcing element 50 forces the walls of the resistance recess and the depending cylindrical snap-on pipe 30 upwardly.

The smaller, gentler gradient at 45 (FIG. 7) of the resistance recess wall 44 is similar or identical to the gradient of side wall 54 of the forcing element of the container, which faces resistance recess wall 44 during unscrewing/opening. The gradient of wall of 44 at section 45 is within the range of between 10 degrees more and 10 degrees less than that of wall 54. Thus, if wall 54 is 45 degrees, wall 44 at section 45 is within the range of from 35 degrees to 55 degrees. Each of wall 44 and 54 is within the range of between 30 and 85 degrees. The gradient of wall 44 at section 45 is measured relative to a horizontal line drawn through rim section 56. The gradient of wall 54 is measured at the point at which it first contacts wall 44 upon rotation and is measured with respect to a horizontal line intersecting the point of contact with wall 44, the line being parallel to, or coincident with, bottom rim section 56.

Further counterclockwise rotation of closure 22 during removal of the closure by the consumer will result in forcing element 50 clearing resistance recess wall 44, and the top 58 of the forcing element contacting section 56 of bottom rim 43 of the cylindrical snap-on pipe. Upon still further unscrewing/opening, counterclockwise, rotation of closure 22, top 58 of forcing element 50 encounters guidance recess 70, seen e.g., in FIG. 7. Guidance recess 70 includes an upwardly extending wall 72 at a gradient within is the range of 90 and 135 degrees to a horizontal line drawn through section 56 of the bottom rim and then a downwardly extending wall 74 at a less severe gradient of within the range of 0 to 10 degrees relative to a horizontal line drawn through the intersection 75 of wall 74 and pipe bottom 43.

The distance between resistance recess 42 and the guidance recess 70 is measured along bottom rim section 56 from the point at which wall 44 merges with snap on pipe bottom end or rim 43 to the point at which guidance recess wall 70 begins to ascend at the beginning of wall 72. The distance between the resistance recess and The distance is typically from 2 mm up to 5 mm, especially from 2 mm to 4 mm.

The presence of the guidance recess in addition to the resistance recess also facilitates rotation of the closure in the opposite, closing, direction, which is generally clockwise. When the closure is rotated in the clockwise, closing direction, at point 75 (FIG. 5), forcing element 50 encounters gradually upwardly sloping wall 74 of guidance recess 70, then the steeper, downward slope of wall 72, then rim 43 at section 56 and finally resistance recess wall 44 and steep wall 46.

In operation, during manufacture of the package, closure 22 is snap fit onto neck 32 (e.g., FIG. 2) of bottle 20 by closure 22 being pressed axially downwardly (or bottle 20 being pressed axially upwardly, or both), Since the bottle body and the closure are made of a flexible material and/or because the presence of one or more recesses in the pipe permits the cylindrical snap-on pipe 30 to expand resiliently radially, the internal thread 34 on the cylindrical snap-on pipe passes over the external thread 60 on the container neck and the closure snaps onto the neck. Thus, the closure is securely attached to the container and a substantial amount of effort would be needed for the consumer or other external force to separate them using a strictly vertical or upward axial motion. Alternatively, closure 22 may initially be applied onto container 20 by being rotated on, to engage the threads.

In normal use, the product is dispensed with cover 26 removed from opening 36. Cover 26 is then closed so that plug 40 seals the opening when the product is not in use.

When the bottle is substantially empty of the shampoo, body wash, lotion or other product originally contained within, the consumer removes closure 22 from the package to facilitate refilling and reusing it. To initiate removal of the closure, the consumer rotates it, typically in the counter-clockwise direction, starting from the position shown in FIG. 6 wherein forcing element 50 is at least partly accommodated within recess 42. Forcing element 50 forces closure 22 upwardly upon closure rotation as described above. Cylindrical snap-on pipe thread 34 maintains its position below container neck thread 60 as the closure is rotated at least until the forcing element reaches a position beneath the second guidance recess wall 72, preferably until the forcing element reaches a position beyond the position beneath the second guidance recess wall. That is, the threads maintain their relative axial positions until the forcing element reaches such positions.

Forcing element 50 next encounters section 56 of bottom rim 43 of the cylindrical snap-on pipe and then upwardly extending wall 72 of guidance recess 70. The latter permits the cylindrical snap-on pipe axially to lower itself toward the container neck. Cylindrical snap-on pipe thread 34 remains below thread 60 whereupon the consumer can continue to use a normal rotation to unscrew the closure from the container neck. FIG. 5 shows forcing element 50 within recess 70. This unscrewing rotation may optionally be further facilitated by forcing element top 58 contacting downwardly extending wall 74 of guidance recess 70. Optional contact by the top 58 with downwardly extending wall 74 may raise the closure cylindrical snap-on pipe to support the normal unscrewing action of the closure, whereby the closure is easily removed. The pitch of the threads is similar to the gradient of wall 74.

At some point in the opening rotation, preferably after the forcing element is beyond a location beneath the second guidance recess wall, the cylindrical snap-on pipe thread may optionally pass axially over the bottle thread whereby removal of the closure is facilitated. If this occurs, typically it will happen further into rotation in the opening direction than the position shown for forcing element 50 in FIG. 5, e.g. forcing element 50 will be closer to, preferably beyond, point 75. Removal is also facilitated by interruptions in the external neck thread and/or the internal snap-on pipe thread and the flexible material of which the closure is made. Alternatively, as mentioned above the closure may be structured so that once the forcing element is disengaged from the resistance recess, with sufficient axial force the internal thread on the snap on pipe may pass over the external thread of the container neck to facilitate removal of the closure.

With the closure removed, the consumer then refills the bottle with the shampoo or other product. She then applies the closure back onto the bottle either by snapping the closure downwardly over the bottle neck in an axial direction similar to that used in manufacture, or she screws the closure back on to the bottle neck. If she chooses the latter, the clockwise-moving rim 43 of pipe 30 optionally contacts top 58 of forcing element 50. When it reaches point 75 (FIG. 5), it encounters gradually ascending wall 74 which permits lowering of the pipe relative to the bottle neck consistent with the normal screwing downwardly of a closure. At this point, the threads have engaged.

The forward and/or top wall of the forcing element encounters wall 72 of guidance recess 70 which accommodates raising of pipe 30 relative to bottle neck 32 and the top 58 of forcing element 50 optionally contacts section 56 of rim 43. Upon further rotation, forcing element reaches resistance recess wall 44 and pipe 30 moves downwardly as forcing element 50 is accommodated within recess 42. As the consumer rotates the closure closed, internal thread 34 of pipe 30 maintains its position below external thread 60 on bottle neck 32. When forcing element wall 52 encounters steep wall 46 of resistance recess 42 the closure cannot be rotated any further.

The closure can be placed on the container neck securely and economically by strictly vertical/axial placement on the bottle during manufacture, whereas by providing the consumer with the ability readily to rotate the closure for removal and to re-apply it to the bottle, refilling of the container is promoted. Closure 22 may be also be applied onto the container during manufacture by being rotated to engage the threads.

References to upward or downward motion herein assume that container 20 is resting on its base (not shown) at its end opposite the closure.

The closure may be made from polypropylene or polyethylene or similar polymeric materials, and the bottle can be molded from high-density polyethylene or polypropylene or PET. The closure is designed to be durable, resisting normal wear and tear by opening and closing the closure and even by dropping.

Personal care products include products for application to the skin, the scalp or the mouth, such as shampoo, body wash, skin lotions, etc.

It should be understood, of course, that the specific forms of the invention herein illustrated and described are intended to be representative only as certain changes may be made therein without departing from the dear teachings of the disclosure. Accordingly, reference should be made to the following appended claims in determining the full scope of the invention.

What is claimed is:

1. A closure comprising a. an upper wall defining an opening;

b. a cylindrical snap-on pipe depending from the upper wall and extending axially to a bottom end, c. the cylindrical snap-on pipe including at least one resistance recess at the bottom end thereof;

d. the cylindrical snap-on pipe further including at least one thread on an inner wall thereof;

e. the cylindrical snap-on pipe defining opposing first and second walls of the resistance recess;

f. the first and second resistance recess walls having gradients wherein the gradient of one of the first and second resistance recess wads is smaller at least at one point than the gradient on the other of the first and second recess sides at a point lying at the same axial height; and g. the bottom end of the cylindrical snap-on pipe being shaped to include a guidance recess for lowering the cylindrical snap-on pipe thread relative to a container neck, the closure being configured such that the guidance recess includes a first guidance recess wall with an upward gradient and a second guidance recess wall having a downward gradient whereby in a closure closing direction of rotation the first guidance recess wall permits the cylindrical snap-on pipe axially to be lowered toward the container neck having a fording element and the second wall in consistent with the closure cylindrical snap-on pipe being raised relative to the container and the thread maintains its axial position relative to a thread on a bottle neck to which the closure is being applied when the forcing element contacts the small gradient resistance recess wall at least until the forcing element reaches a position beneath the second guidance recess wall.

2. The closure according to claim 1 further including a closing cover for closing the opening, the closing cover being hingedly attached to a closure base of the closure.

3. The closure according to claim 1 wherein in the direction of rotation to unscrew the closure, after encountering the resistance recess the forcing element encounters the first guidance recess wall and then the second guidance recess wall.

4. The closure according to claim 1 wherein when the forcing element reaches a position below the first guidance recess wall the cylindrical snap-on pipe thread and the container thread maintain their relative axial positions with the container thread above the snap on pipe thread.

5. The closure according to claim 1 wherein the second resistance recess wall includes the smaller gradient and the smaller gradient of the second resistance recess wall is from 10 degrees less to 10 degrees more than a gradient of a side wall of the forcing element of the container which faces the second resistance recess wall during unscrewing the closure, and the smaller gradient of the second resistance wall and the side wall of the forcing element facing said second resistance wall having gradients of between 30 and 85 degrees.

6. A container comprising a combined closure and bottle, which includes a closure and a bottle having a bottle neck and at least one forcing element, I. the closure including a) an upper wall defining an opening b) a cylindrical snap-on pipe depending from the upper wall and extending axially to a bottom end, c) the cylindrical snap-on pipe including at least one resistance recess therein extending to the bottom end;

d) the cylindrical snap-on pipe further including one or more threads on an inner wall thereof;

e) the cylindrical snap-on pipe defining opposing first and second walls of the resistance recess;

f) the first and second resistance recess walls having gradients wherein the gradient of one of the first and second sides is smaller at least at one point than the gradient on the other of the first and second recess sides at a point lying at the same axial height; and g) the bottom end of the cylindrical snap-on pipe being shaped to include a guidance recess for lowering and raising the cylindrical snap-on pipe threads relative to the bottle neck, II. the bottle neck having external threads, the at least one bottle forcing element being adapted to be at least partly received within the resistance recess of the closure cylindrical snap-on pipe, wherein the guidance recess includes a first wall with an upward gradient and a second wall having a downward gradient whereby in a closure closing direction of rotation the first guidance recess wall permits the cylindrical snap-on pipe axially to be lowered toward the forcing element and the second guidance recess wall being consistent with the closure cylindrical snap-on pipe being raised relative to the closing element, the snap-on pipe internal thread and the bottle neck thread maintaining their relative axial positions with the bottle neck thread above the snap on pipe thread when the forcing element contacts the small gradient resistance recess wall at least until the forcing element reaches a position beneath the second guidance recess wall.

7. The container according to claim 6 wherein after the forcing element reaches a position below the second guidance recess wall the cylindrical snap-on pipe thread passes axially over the bottle thread with the addition of axial force.

8. The closure according to claim wherein the distance between the resistance recess and the guidance recess in the unscrewing direction is at least 2 mm.

9. The closure according to claim 8 wherein the distance between the resistance recess and the guidance recess in the unscrewing direction is from 2 mm up to 5 mm.

10. The closure according to claim 9 wherein the distance between the resistance recess and the guidance recess in the unscrewing direction is from 2 mm up to 4 mm.

11. The closure according to claim 1 wherein the first guidance recess wall has a gradient of from 90 to 135 degrees.

12. The closure according to claim 1 wherein the second guidance recess wall has a gradient of from 0 to10 degrees.

13. The container according to claim 6 wherein the second resistance recess wall includes the smaller gradient and the smaller gradient of the second resistance recess wall is from 10 degrees less to 10 degrees more than a gradient of the side wall of the forcing element of the container which faces the second resistance recess wall during unscrewing the closure, and the smaller gradient of the second resistance wall and the side wall of the forcing element facing said second resistance wall having gradients of between 30 and 85 degrees.

14. A closure comprising a. an upper wall defining an opening;

b. a cylindrical snap-on pipe depending from the upper wall and extending axially to a bottom end, c. the cylindrical snap-on pipe including at least one resistance recess at the bottom end thereof;

d. the cylindrical snap-on pipe further including at least one thread on an inner wall thereof;

e. the cylindrical snap-on pipe defining opposing first and second walls of the resistance recess;

f. the first and second resistance recess walls having gradients wherein the gradient of one of the first and second resistance recess walls is smaller at least at one point than the gradient on the other of the first and second recess sides at a point lying at the same axial height; and g. the bottom end of the cylindrical snap-on pipe being shaped to include a guidance recess for lowering the cylindrical snap-on pipe thread relative to a container neck the closure being configured such that the guidance recess includes a first wall with an upward gradient and a second wall having a downward gradient whereby in a closure closing direction of rotation the first guidance recess wall permits the cylindrical snap-on pipe axially to be lowered toward the forcing element and the second guidance recess wall being consistent with the closure cylindrical snap-on pipe being raised relative to the closing element, the closure being made of a flexible material.

15. A container comprising a combined closure and bottle, which includes a closure and a bottle having a bottle neck and at least one forcing element, I. the closure including h) an upper wall defining an opening;

i) a cylindrical snap-on pipe depending from the upper wall and extending axially to a bottom end, j) the cylindrical snap-on pipe including at least one resistance recess therein extending to the bottom end;

k) the cylindrical snap-on pipe further including one or more threads on an inner wall thereof;

l) the cylindrical snap-on pipe defining opposing first and second walls of the resistance recess;

m) the first and second resistance recess walls having gradients wherein the gradient of one of the first and second sides is smaller at least at one point than the gradient on the other of the first and second recess sides at a point lying at the same axial height; and n) the bottom end of the cylindrical snap-on pipe being shaped to include a guidance recess for lowering and raising the cylindrical snap-on pipe threads relative to the bottle neck, II. the bottle neck having external threads, the at least one bottle forcing element being adapted to be at least partly received within the resistance recess of the closure cylindrical snap-on pipe, wherein the guidance recess includes a first wall with an upward gradient and a second wall having a downward gradient whereby a closure dosing direction of rotation the first guidance recess wall permits the cylindrical snap-on pipe axially to be lowered toward the forcing element and the second guidance recess wall consistent with the closure cylindrical snap-on pipe being raised relative to the closing element, the closure being made of a flexible material and/or the bottle containing a personal care product.

16. The closure of claim 14 wherein the closure is structured such that with sufficient axial force, even with the initial rotation, the internal thread on the snap on pipe may pass over the external thread of the container neck to facilitate removal of the closure once the forcing element is disengaged from the resistance recess.

17. The container of claim 15 wherein the closure is structured such that with sufficient axial force, even with the initial rotation, the internal thread on the snap on pipe may pass over the external thread of the container neck to facilitate removal of the closure once the forcing element is disengaged from the resistance recess.

18. A container comprising a combined closure and bottle, which includes a closure and a bottle having a bottle neck and at least one forcing element, I. the closure including o) an upper wall defining an opening;

p) a cylindrical snap-on pipe depending from the upper wall and extend axially to a bottom end, q) the cylindrical snap-on pipe including at least one resistance recess therein extending to the bottom end;

r) the cylindrical snap-on pipe further including threads on an inner wall thereof;

s) the cylindrical snap-on pipe defining opposing first and second walls of the resistance recess;

t) the first and second resistance recess walls having gradients wherein the gradient of one of the first and second sides is smaller at least at one point than the gradient on the other of the first and second recess sides at a point lying at the same axial height; and u) the bottom end of the cylindrical snap-on pipe being shaped to include a guidance recess for lowering and raising the cylindrical snap-on pipe threads relative to the bottle neck, II. the bottle neck having external threads, the at least one bottle forcing element being adapted to be at least partly received within the resistance recess of the closure cylindrical snap-on pipe, the closure being made of a flexible material and/or the bottle containing a personal care product.

19. A closure comprising a. an upper wall defining an opening;

b. a cylindrical snap-on pipe depending from the upper wall and extending axially to a bottom end, c. the cylindrical snap-on pipe including at least one resistance recess at the bottom end thereof;

d. the cylindrical snap-on pipe further including at least one thread on an inner wall thereof;

e. the cylindrical snap-on pipe defining opposing first and second walls of the resistance recess;

f. the first and second resistance recess walls having gradients wherein the gradient of one of the first and second resistance recess walls is smaller at least at one point than the gradient on the other of the first and second recess sides at a point lying at the same axial height; and g. the bottom end of the cylindrical snap-on pipe being shaped to include a guidance recess for lowering the cylindrical snap-on pipe thread relative to a container neck, the closure being made of a flexible material.

* * * * *